US008893600B2

(12) United States Patent
Zhang

(10) Patent No.: US 8,893,600 B2
(45) Date of Patent: Nov. 25, 2014

(54) DUST PROTECTION METHOD FOR GLASS SUBSTRATE CUTTER

(71) Applicant: Shenzhen China Star Optoelectronics Technology Co., Ltd., Shenzhen (CN)

(72) Inventor: Xindi Zhang, Shenzhen (CN)

(73) Assignee: Shenzhen China Star Optroelectronics Technology Co., Ltd., Shenzhen, Guangdong Province (CN)

( * ) Notice: Subject to any disclaimer, the term of this patent is extended or adjusted under 35 U.S.C. 154(b) by 195 days.

(21) Appl. No.: 13/806,736

(22) PCT Filed: Oct. 11, 2012

(86) PCT No.: PCT/CN2012/082740

§ 371 (c)(1),
(2), (4) Date: Dec. 21, 2012

(87) PCT Pub. No.: WO2014/047971

PCT Pub. Date: Apr. 3, 2014

(65) Prior Publication Data

US 2014/0090529 A1 Apr. 3, 2014

(30) Foreign Application Priority Data

Sep. 28, 2012 (CN) ..... 2012 1 0370490

(51) Int. Cl.
*B26D 7/08* (2006.01)

(52) U.S. Cl.
USPC ..... 83/24; 83/53; 83/168

(58) Field of Classification Search
USPC ..... 83/177, 169, 168, 24, 53; 225/94
See application file for complete search history.

(56) References Cited

U.S. PATENT DOCUMENTS

| | | | | |
|---|---|---|---|---|
| 3,877,334 | A * | 4/1975 | Gerber | 83/22 |
| 5,207,815 | A * | 5/1993 | Wright | 65/332 |
| 5,349,788 | A * | 9/1994 | Nedo et al. | 451/75 |
| 5,870,937 | A * | 2/1999 | Reis et al. | 83/24 |
| 6,024,003 | A * | 2/2000 | Newman et al. | 83/24 |
| 6,103,049 | A * | 8/2000 | Batdorf | 156/251 |
| 6,276,246 | B1 * | 8/2001 | Bezama et al. | 83/24 |
| 2003/0037650 | A1 * | 2/2003 | Knaupp et al. | 83/53 |
| 2004/0211218 | A1 * | 10/2004 | Jotaki | 65/105 |
| 2006/0053991 | A1 * | 3/2006 | Arikita | 83/168 |

(Continued)

FOREIGN PATENT DOCUMENTS

| | | | |
|---|---|---|---|
| CN | 101759354 | A | 6/2010 |
| CN | 102211860 | A | 10/2011 |

(Continued)

*Primary Examiner* — Sean Michalski
(74) *Attorney, Agent, or Firm* — Cheng-Ju Chiang

(57) ABSTRACT

A dust protection method for a glass substrate cutter includes the following steps: (1) providing a cutter and a glass-substrate-to-be-cut, wherein the cutter includes a cutter body, a cutting blade, a cover plate assembly, and suction tubes, the cover plate assembly forming a first slit corresponding to the cutting blade: (2) positioning and fixing the glass-substrate-to-be-cut on the cutter body and closing the cover plate to form a second slit between the glass-substrate-to-be-cut and the cover plate; (3) introducing a pressurized gas flow into the second slit at edges of the glass-substrate-to-be-cut and activating the suction tubes to draw in the gas; and (4) controlling the cutting blade to proceed with a cutting operation along the first slit to complete the processing of the glass substrate.

11 Claims, 4 Drawing Sheets

(56) References Cited

U.S. PATENT DOCUMENTS

| | | | | |
|---|---|---|---|---|
| 2008/0028904 | A1* | 2/2008 | Arikita | 83/24 |
| 2008/0216625 | A1* | 9/2008 | Li et al. | 83/72 |
| 2008/0245201 | A1* | 10/2008 | Darzi et al. | 83/24 |
| 2010/0024618 | A1* | 2/2010 | Minemura et al. | 83/168 |
| 2010/0186565 | A1* | 7/2010 | Saari et al. | 83/100 |
| 2011/0219925 | A1* | 9/2011 | Singh | 83/53 |
| 2011/0271807 | A1* | 11/2011 | Bottcher | 83/22 |
| 2012/0073417 | A1* | 3/2012 | Ujiie et al. | 83/24 |
| 2012/0111168 | A1* | 5/2012 | Ota | 83/168 |
| 2013/0213200 | A1* | 8/2013 | Cooper | 83/23 |

FOREIGN PATENT DOCUMENTS

| | | | |
|---|---|---|---|
| CN | 102503106 | A | 6/2012 |
| CN | 102503107 | A | 6/2012 |
| KR | 10-2010-0061137 | A | 6/2010 |

* cited by examiner

DUST PROTECTION METHOD FOR GLASS SUBSTRATE CUTTER

BACKGROUND OF THE INVENTION

1. Field of the Invention

The present invention relates to the field of liquid crystal displays, and in particular to a dust protection method for a glass substrate cutter.

2. The Related Arts

Liquid crystal display (LCD) has a variety of advantages, such as thin device body, low power consumption, and being free of radiation, and is thus widely used. Most of the LCDs that are currently available in the market are backlighting LCDs, which comprise a liquid crystal panel and a backlight module. The operation principle of the liquid crystal panel is that liquid crystal molecules are interposed between two parallel glass substrates and a plurality of vertical and horizontal fine electrical wires is arranged between the two glass substrates, whereby the liquid crystal molecules are controlled to change direction by application of electricity in order to refract light emitting from the backlight module for generating images. Since the liquid crystal panel itself does not emit light, light must be provided by the backlight module in order to normally display images. Thus, the backlight module is one of the key components of an LCD. The backlight module can be classified in two types, namely side-edge backlight module and direct backlight module, according to the position where light gets incident. The direct backlight module arranges a light source, such as a cold cathode fluorescent lamp (CCFL) or a light-emitting diode (LED), at the back side of the liquid crystal panel to form a planar light source that directly provides lighting to the liquid crystal panel. The side-edge backlight module arranges an LED light bar of a backlight source at an edge of a backplane that is located rearward of one side of the liquid crystal panel. The LED light bar emits light that enters a light guide plate (LGP) through a light incident face of the light guide plate and is projected out through a light emergence face of the light guide plate, after being reflected and diffused, to thereby transmit through an optic film assembly to form a planar light source for the liquid crystal panel.

Whether a liquid crystal display is good or poor is first determined by the panel used, because the quality of the panel directly affects the impression of viewing the screen. In addition, the liquid crystal panel takes more than one half of the overall cost of the display device and is a primary factor that affects the expense of manufacturing a liquid crystal television. To quite an extent, the liquid crystal panel may determine important parameters of the liquid crystal display, such as brightness, contrast, color, and viewing angle.

In the processing of a liquid crystal panel, what is first done is cutting a glass substrate. In the known processes, in cutting a glass substrate, patterns that are formed on the glass substrate are exposed on surface and are easily affected by particles generated by the cutting operation, especially the glass chips generated in making the cutting that cause severe damages to the patterns. To alleviate the influence of the particles generated in a cutting process on a glass panel component, some manufacturers use laser cutting devices to replace the conventionally used cutting wheel cutter. Although the laser cutter generates much less particles in a process of cutting glass than cutting wheel cutter, yet in view of the number, it may still affect the quality of the glass panel component and may cause adverse situations on the glass panel components, such as defects and scratches. To further reduce the amount of particles generated, further improvement is needed for the existing cutters.

SUMMARY OF THE INVENTION

An object of the present invention is to provide a dust protection method for a glass substrate cutter, which well prevent particles from falling onto a glass substrate to cause damage to patterns of the glass substrate by means of arrangement of a cover plate assembly, a pressurized air flow, and suction tubes to block or suck away particles generated by cutting operation thereby achieving the purposes of protecting the patterns of the glass substrate.

To achieve the above object, the present invention provides a dust protection method for a glass substrate cutter, comprising the following steps:

(1) providing a cutter and a glass-substrate-to-be-cut, wherein the cutter comprises a cutter body, a cutting blade mounted above the cutter body, a cover plate assembly mounted on the cutter body to correspond to the cutting blade, and suction tubes arranged at opposite sides of the cutting blade, the cutter body comprising a platform that bears the glass-substrate-to-be-cut thereon, the cover plate assembly and the cutting blade being arranged above the platform, the cover plate assembly forming a first slit corresponding to the cutting blade;

(2) positioning and fixing the glass-substrate-to-be-cut on the platform and closing the cover plate assembly in such a way that a second slit is formed between the glass-substrate-to-be-cut and the cover plate assembly;

(3) introducing a pressurized gas flow into the second slit at edges of the glass-substrate-to-be-cut and controlling the pressurized gas flow to blow toward the first slit, while at the same time making the suction tubes drawing in the gas; and (4) controlling the cutting blade to proceed with the cutting operation along the first slit to complete cutting of the glass substrate, where the particles generated during the cutting operation are either sucked away by the suction tubes or deposit on the cover plate assembly.

The cover plate assembly comprises two first cover plates, two second cover plates arranged between the two first cover plates, a frame fit over outer edges of the first and second cover plates, and a plurality of mounting posts mounted to two opposite sides of the frame. The first cover plates are conventional ordinary cover plates. The second cover plates are ordinary cover plates.

The first slit is located between the two second cover plates.

The first slit comprises a third slit and a fourth slit. The third slit is arranged between the two second cover plates. The third slit and the fourth slit are arranged to show a cruciform configuration.

The first cover plates each comprise a third cover plate located at one side of the fourth slit and a fourth cover plate located at another side of the fourth slit. The second cover plates each comprise a fifth cover plate located at one side of the fourth slit and a sixth cover plate located at another side of the fourth slit. The frame is fit over outer edges of the third, fourth, fifth, and sixth cover plates.

The second slit is of a size of 0.5-2 mm.

The second slit is of a size of 1 mm.

The cutter body comprises a robot corresponding to the glass-substrate-to-be-cut and an elevation mechanism corresponding to the cover plate. The robot functions to carry out operations of picking up and positioning the glass substrate. The elevation mechanism comprises a groove formed in the platform and a driving motor arranged to correspond to the cover plate assembly. The cover plate assembly is receivable in the groove. The groove has sidewalls forming recesses corresponding to the mounting posts of the cover plate assembly. The recess comprises a horizontal channel and down channels formed at two ends of the horizontal channel.

When the robot moves the glass-substrate-to-be-cut to the platform or moves a cut glass substrate from the glass substrate, the robot extends to the platform and the mounting posts of the cover plate slide up to the horizontal channel, whereby the robot, after completing the operation, is retrieved from the platform to allow the mounting posts of the cover plate to slide down into the down channels.

The cutter body is a cutting wheel cutter body or a laser cutter body.

The present invention also provides a dust protection method for a glass substrate cutter, which comprises the following steps:

(1) providing a cutter and a glass-substrate-to-be-cut, wherein the cutter comprises a cutter body, a cutting blade mounted above the cutter body, a cover plate assembly mounted on the cutter body to correspond to the cutting blade, and suction tubes arranged at opposite sides of the cutting blade, the cutter body comprising a platform that bears the glass-substrate-to-be-cut thereon, the cover plate assembly and the cutting blade being arranged above the platform, the cover plate assembly forming a first slit corresponding to the cutting blade;

(2) positioning and fixing the glass-substrate-to-be-cut on the platform and closing the cover plate assembly in such a way that a second slit is formed between the glass-substrate-to-be-cut and the cover plate assembly;

(3) introducing a pressurized gas flow into the second slit at edges of the glass-substrate-to-be-cut and controlling the pressurized gas flow to blow toward the first slit, while at the same time making the suction tubes drawing in the gas; and (4) controlling the cutting blade to proceed with the cutting operation along the first slit to complete cutting of the glass substrate, where the particles generated during the cutting operation are either sucked away by the suction tubes or deposit on the cover plate assembly;

wherein the cover plate assembly comprises two first cover plates, two second cover plates arranged between the two first cover plates, a frame fit over outer edges of the first and second cover plates, and a plurality of mounting posts mounted to two opposite sides of the frame, the first cover plates being conventional ordinary cover plates, the second cover plates being ordinary cover plates;

wherein the first slit is located between the two second cover plates;

wherein the second slit is of a size of 0.5-2 mm;

wherein the second slit is of a size of 1 mm;

wherein the cutter body comprises a robot corresponding to the glass-substrate-to-be-cut and an elevation mechanism corresponding to the cover plate, the robot functioning to carry out operations of picking up and positioning the glass substrate, the elevation mechanism comprising a groove formed in the platform and a driving motor arranged to correspond to the cover plate assembly, the cover plate assembly being receivable in the groove, the groove having sidewalls forming recesses corresponding to the mounting posts of the cover plate assembly, the recess comprising a horizontal channel and down channels formed at two ends of the horizontal channel;

wherein when the robot moves the glass-substrate-to-be-cut to the platform or moves a cut glass substrate from the glass substrate, the robot extends to the platform, the mounting posts of the cover plate sliding up to the horizontal channel, whereby the robot, after completing the operation, is retrieved from the platform to allow the mounting posts of the cover plate to slide down into the down channels; and wherein the cutter body is a cutting wheel cutter body or a laser cutter body.

The efficacy of the present invention is that the present invention provides a dust protection method for a glass substrate cutter, which comprises a cover plate assembly arranged at the site of a cutting blade to block particles and also comprises a pressurized gas flow that is introduced between the glass substrate and the cover plate assembly and suction tubes arranged at opposite sides of the cutting blade to suck away the particles so that the particles are well prevented from falling onto the glass substrate to cause damage to patterns of the glass substrate thereby achieving the purposes of protecting the patterns of the glass substrate.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of one or more embodiments of the present invention, with reference to the attached drawings. In the drawings.

DETAILED DESCRIPTION OF THE PREFERRED EMBODIMENTS

Figure 1:
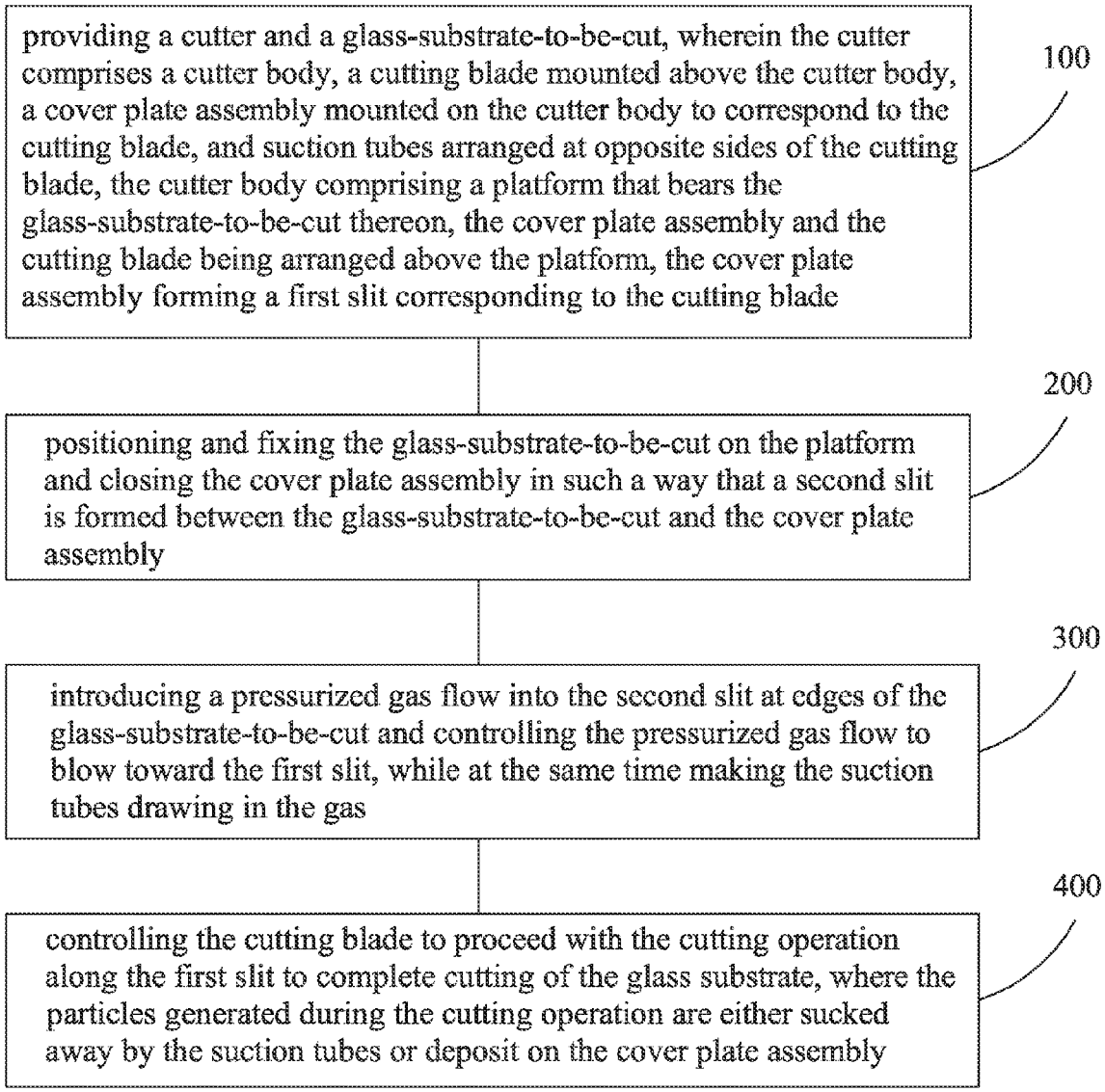
FIG. 1 is a flow chart illustrating a dust protection method for a glass substrate cutter according to the present invention.
Figure 2:
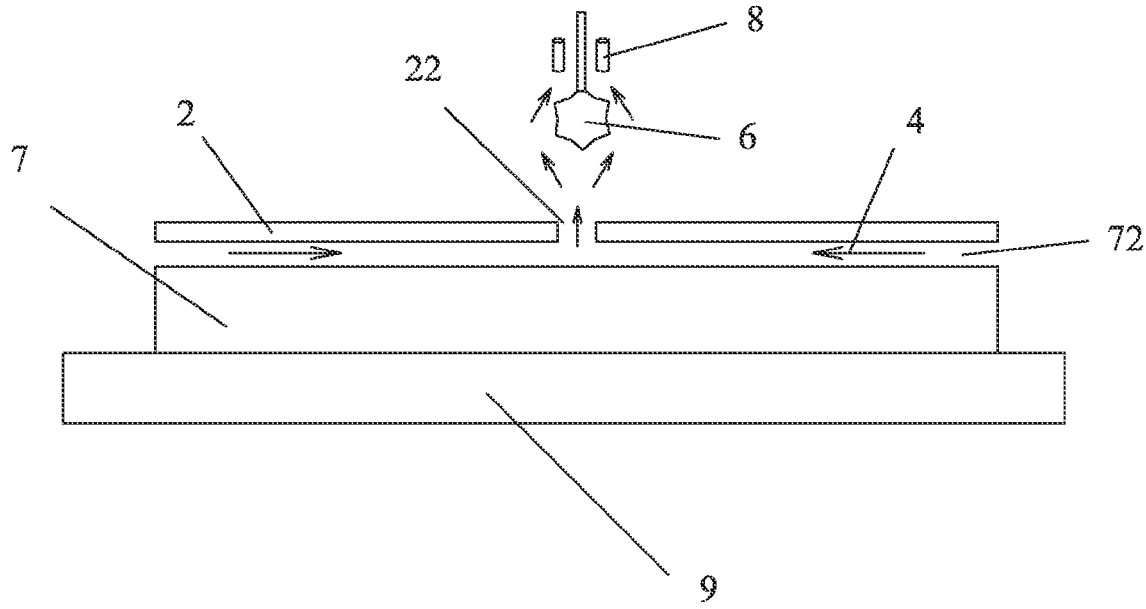
FIG. 2 is a schematic view showing a cutting site in the dust protection method for a glass substrate cutter according to the present invention.
Figure 3:
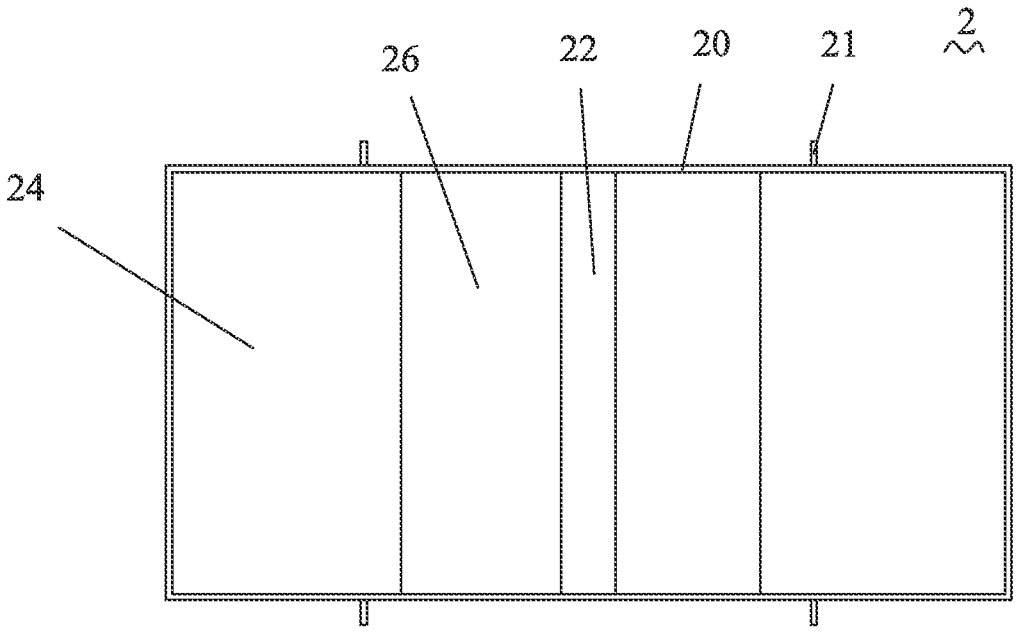
FIG. 3 is a schematic view showing the structure of a first preferred embodiment of a cover plate assembly used in the dust protection method for a glass substrate cutter according to the present invention.
Figure 4:
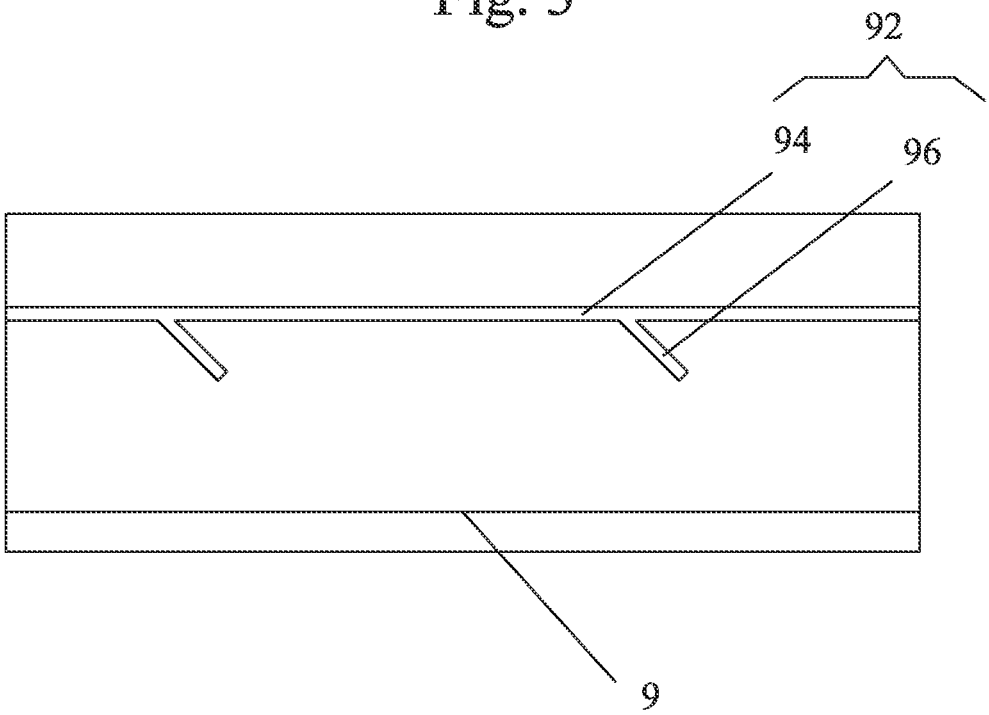
FIG. 4 is a side elevational view showing a platform used in the dust protection method for a glass substrate cutter according to the present invention.

To further expound the technical solution adopted in the present invention and the advantages thereof, a detailed description is given to a preferred embodiment of the present invention and the attached drawings.

Referring to FIGS. 1-4, the present invention provides a dust protection method for a glass substrate cutter, which comprises the following steps:

Step 100: providing a cutter and a glass-substrate-to-be-cut 7, wherein the cutter comprises a cutter body (not shown), a cutting blade 6 mounted above the cutter body, a cover plate assembly 2 mounted on the cutter body to correspond to the cutting blade 6, and suction tubes 8 arranged at opposite sides of the cutting blade 6. The cutter body comprises a platform 9 that bears the glass-substrate-to-be-cut 7 thereon. The cover plate assembly 2 and the cutting blade 6 are arranged above the platform 9. The cover plate assembly 2 forms a first slit 22 corresponding to the cutting blade 6.

In the instant embodiment, the cover plate assembly 2 comprises two first cover plates 24, two second cover plates 26 arranged between the two first cover plates 24, a frame 20 fit over outer edges of the first and second cover plates 24, 26, and a plurality of mounting posts 21 mounted to two opposite sides of the frame 20. The first slit 22 is located between the two second cover plates 26. The first cover plates 24 are conventional ordinary cover plates showing no special functionality. The second cover plates 26 are ordinary cover plates. Gas of a pressurized gas flow is allowed to blow out from the second cover plates 26. The mounting posts are of a number of 4 and are of a rectangular configuration. The first and second cover plates 24, 26 are fixed in position by the frame 20 so as to have the first and second cover plates 24, 26 combined together as a unity. The frame 20 is mounted through the mounting posts 21 to the cutter body. In a cutting operation, the edge of the cutting blade 6 cuts the glass-substrate-to-be-cut 7 in the first slit 22 in order to make the particles and dusts that are generated in the cutting operation fall as much as possible onto the cover plate assembly 2. This arrangement of the cover plate assembly 2 is provided for bisectional cutting of the glass substrate.

The cutter body further comprises a robot corresponding to the glass-substrate-to-be-cut 7 and an elevation mechanism corresponding to the cover plate (both not shown). The robot functions to carry out operations of picking up and positioning the glass substrate. The elevation mechanism comprises a groove (not shown) formed in the platform and a driving motor arranged to correspond to the cover plate assembly 2. The cover plate assembly 2 is receivable in the groove. The groove has sidewalls forming recesses 92 corresponding to the mounting posts 21 of the cover plate assembly. The mounting posts 21 of the cover plate assembly 2 are mounted in the recesses 92 and are slidable along the recesses 92. The recess 92 comprises a horizontal channel 94 and down channels 96 formed at two ends of the horizontal channel 94. The down channels 96 are set at a predetermined angle with respect to the horizontal channel 94.

The cutter body can be a cutting wheel cutter body or a laser cutter body.

Step 200: positioning and fixing the glass-substrate-to-be-cut 7 on the platform 9 and closing the cover plate assembly 2 in such a way that a second slit 72 is formed between the glass-substrate-to-be-cut 7 and the cover plate assembly 2.

When the robot moves the glass-substrate-to-be-cut 7 above the platform 9, the motor drives the cover plate assembly 2 in such a way that the mounting posts 21 of the cover plate assembly 2 are caused to slide into the horizontal channel 94. While the glass-substrate-to-be-cut 7 is positioned and fixed on the platform 9, the robot is retrieved from the platform 9 to allow the mounting posts 21 of the cover plate assembly 2 to slide down along the down channels 96 thereby allowing the cover plate 21 to shield the glass-substrate-to-be-cut 7.

In the instant embodiment, the second slit 72 is of a size of 0.5-2 mm, preferably 1 mm.

Step 300: introducing a pressurized gas flow 4 into the second slit 72 at the edges of the glass-substrate-to-be-cut 7 and controlling the pressurized gas flow 4 to blow toward the first slit 22, while at the same time making the suction tubes 8 drawing in the gas.

The second slit 72 receives the pressurized gas flow 4 to flow therein and controls a sweeping direction of the pressurized gas flow 4 to allow the gas of the pressurized gas flow 4 to flow into the first slit 22 and then discharge through the first slit 22 for well prevent particles and dusts from depositing between the glass-substrate-to-be-cut 7 and the cover plate assembly 2 and falling onto a surface of the glass-substrate-to-be-cut 7 to cause damage to patterns of the glass-substrate-to-be-cut 7. Meanwhile, the suction tubes 8 are activated to draw in the gas so that under the condition that the gas flow in the first slit 22 is controlled, the particles and dusts generated in the cutting operation are sucked away.

Step 400: controlling the cutting blade 6 to proceed with the cutting operation along the first slit 22 to complete cutting of the glass substrate, where the particles generated during the cutting operation are either sucked away by the suction tubes 8 or deposit on the cover plate assembly 2.

After the completion of cutting, to allow the robot to move away the cut glass substrate from the platform 9, the robot extends to the platform 9 and the motor drives the cover plate assembly 2 to cause the mounting posts 21 of the cover plate assembly 2 to slide up to the horizontal channel 94. After the completion of the movement, the robot retrieves from the platform 9, the mounting posts 21 of the cover plate assembly 2 slide down into the down channels 96 so that the cover plate assembly is received in the groove.

By additionally arranging the cover plate assembly 2 above the glass substrate cutter, particles generated during the cutting operation can be well prevented from falling onto the glass-substrate-to-be-cut 7 and in addition, introducing the pressurized gas flow 4 between the glass-substrate-to-be-cut 7 and the cover plate assembly 2 and controlling the discharging of the pressurized gas flow 4 through the first slit 22, the particles are well prevented from depositing between the glass-substrate-to-be-cut 7 and the cover plate assembly 2 to fall onto the glass-substrate-to-be-cut 7, whereby the patterns on the glass-substrate-to-be-cut 7 can be well protected.

Figure 5:
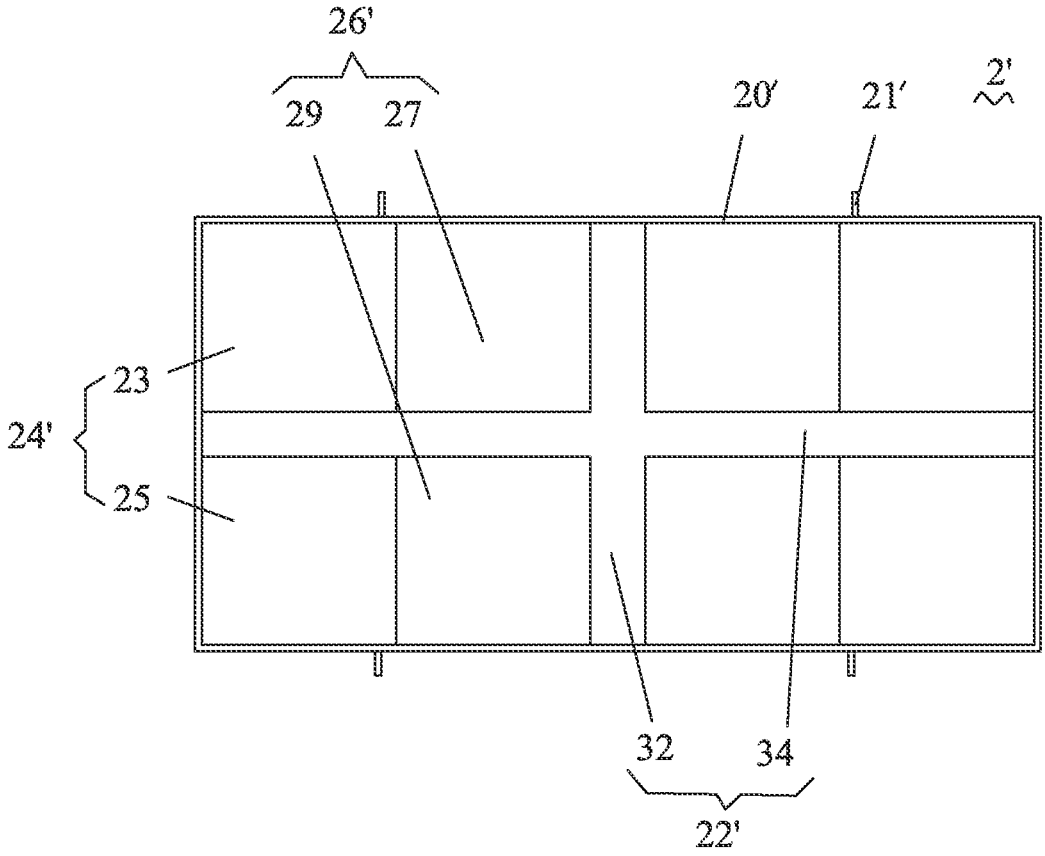
FIG. 5 is a schematic view showing the structure of a second preferred embodiment of a cover plate assembly used in the dust protection method for a glass substrate cutter according to the present invention.

Referring to FIG. 5, an alternative preferred embodiment is provided, wherein the cover plate assembly 2' is arranged for quadrisectional cutting of the glass substrate. The instant preferred embodiment is a modification made on the basis of the first preferred embodiment. The first slit 22' comprises a third slit 32 and a fourth slit 34. The third slit 32 is arranged between the two second cover plates 26' and the third slit 32 and the fourth slit 34 are arranged to show a cruciform configuration.

The first cover plates 24' each comprise a third cover plate 23 located at one side of the fourth slit 34 and a fourth cover plate 25 located at another side of the fourth slit 34. The third cover plate 23 and the fourth cover plate 25 are conventional ordinary cover plates showing no special functionality. The second cover plates 26' each comprise a fifth cover plate 27 located at one side of the fourth slit 34 and a sixth cover plate 29 located at another side of the fourth slit 34. The fifth cover plate 27 and the sixth cover plate 29 are ordinary cover plates. Gas of a pressurized gas flow is allowed to blow out from the fifth cover plates 27 and the sixth cover plates 29. The frame 20' is fit over outer edges of the third, fourth, fifth, and sixth cover plates 23, 25, 27, 29 so as to have the third, fourth, fifth, and sixth cover plates 23, 25, 27, 29 combined together as a unity. The frame 20' is mounted through the mounting posts 21' to the cutter body.

In the instant embodiment, Steps 1-3 are similar to those of the first preferred embodiment, while Step 4 is that the cutting blade 6 carries out cutting operation along the third and fourth slits 32, 34 and after completion of the processing of the glass substrate, the particles generated during the cutting operation will be sucked away by the suction tubes 8 or deposit on the cover plate 2'.

However, the present invention is not limited to the above arrangements for bisectional cutting and quadrisectional cutting and can be modified to provide various manner of cutting as desired. The basic operation principle maintains the same.

In summary, the present invention provides a dust protection method for a glass substrate cutter, which comprises a cover plate assembly arranged at the site of a cutting blade to block particles and also comprises a pressurized gas flow that is introduced between the glass substrate and the cover plate assembly and suction tubes arranged at opposite sides of the cutting blade to suck away the particles so that the particles are well prevented from falling onto the glass substrate to cause damage to patterns of the glass substrate thereby achieving the purposes of protecting the patterns of the glass substrate.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A dust protection method for a glass substrate cutter, comprising the following steps:

(1) providing a cutter and a glass-substrate-to-be-cut, wherein the cutter comprises a cutter body, a cutting blade mounted above the cutter body, a cover plate assembly mounted on the cutter body to correspond to the cutting blade, and suction tubes arranged at opposite sides of the cutting blade, the cutter body comprising a platform that bears the glass-substrate-to-be-cut thereon, the cover plate assembly and the cutting blade being arranged above the platform, the cover plate assembly forming a first slit corresponding to the cutting blade;

(2) positioning and fixing the glass-substrate-to-be-cut on the platform and closing the cover plate assembly in such a way that a second slit is formed between the glass-substrate-to-be-cut and the cover plate assembly;

(3) introducing a pressurized gas flow into the second slit at edges of the glass-substrate-to-be-cut and controlling the pressurized gas flow to blow toward the first slit, while at the same time making the suction tubes drawing in the gas; and (4) controlling the cutting blade to proceed with the cutting operation along the first slit to complete cutting of the glass substrate, where the particles generated during the cutting operation are either sucked away by the suction tubes or deposit on the cover plate assembly.

2. The dust protection method for a glass substrate cutter as claimed in claim 1, wherein the cover plate assembly comprises two first cover plates, two second cover plates arranged between the two first cover plates, a frame fit over outer edges of the first and second cover plates, and a plurality of mounting posts mounted to two opposite sides of the frame, the first cover plates being conventional ordinary cover plates, the second cover plates being ordinary cover plates.

3. The dust protection method for a glass substrate cutter as claimed in claim 2, wherein the first slit is located between the two second cover plates.

4. The dust protection method for a glass substrate cutter as claimed in claim 2, wherein the first slit comprises a third slit and a fourth slit, the third slit being arranged between the two second cover plates, the third slit and the fourth slit being arranged to show a cruciform configuration.

5. The dust protection method for a glass substrate cutter as claimed in claim 4, wherein the first cover plates each comprise a third cover plate located at one side of the fourth slit and a fourth cover plate located at another side of the fourth slit, the second cover plates each comprising a fifth cover plate located at one side of the fourth slit and a sixth cover plate located at another side of the fourth slit, the frame being fit over outer edges of the third, fourth, fifth, and sixth cover plates.

6. The dust protection method for a glass substrate cutter as claimed in claim 1, wherein the second slit is of a size of 0.5-2 mm.

7. The dust protection method for a glass substrate cutter as claimed in claim 6, wherein the second slit is of a size of 1 mm.

8. The dust protection method for a glass substrate cutter as claimed in claim 1, wherein the cutter body comprises a robot corresponding to the glass-substrate-to-be-cut and an elevation mechanism corresponding to the cover plate, the robot functioning to carry out operations of picking up and positioning the glass substrate, the elevation mechanism comprising a groove formed in the platform and a driving motor arranged to correspond to the cover plate assembly, the cover plate assembly being receivable in the groove, the groove having sidewalls forming recesses corresponding to the mounting posts of the cover plate assembly, the recess comprising a horizontal channel and down channels formed at two ends of the horizontal channel.

9. The dust protection method for a glass substrate cutter as claimed in claim 8, wherein when the robot moves the glass-substrate-to-be-cut to the platform or moves a cut glass substrate from the glass substrate, the robot extends to the platform, the mounting posts of the cover plate sliding up to the horizontal channel, whereby the robot, after completing the operation, is retrieved from the platform to allow the mounting posts of the cover plate to slide down into the down channels.

10. The dust protection method for a glass substrate cutter as claimed in claim 1, wherein the cutter body is a cutting wheel cutter body or a laser cutter body.

11. A dust protection method for a glass substrate cutter, comprising the following steps:

(1) providing a cutter and a glass-substrate-to-be-cut, wherein the cutter comprises a cutter body, a cutting blade mounted above the cutter body, a cover plate assembly mounted on the cutter body to correspond to the cutting blade, and suction tubes arranged at opposite sides of the cutting blade, the cutter body comprising a platform that bears the glass-substrate-to-be-cut thereon, the cover plate assembly and the cutting blade being arranged above the platform, the cover plate assembly forming a first slit corresponding to the cutting blade;

(2) positioning and fixing the glass-substrate-to-be-cut on the platform and closing the cover plate assembly in such a way that a second slit is formed between the glass-substrate-to-be-cut and the cover plate assembly;

(3) introducing a pressurized gas flow into the second slit at edges of the glass-substrate-to-be-cut and controlling the pressurized gas flow to blow toward the first slit, while at the same time making the suction tubes drawing in the gas; and (4) controlling the cutting blade to proceed with the cutting operation along the first slit to complete cutting of the glass substrate, where the particles generated during the cutting operation are either sucked away by the suction tubes or deposit on the cover plate assembly;

wherein the cover plate assembly comprises two first cover plates, two second cover plates arranged between the two first cover plates, a frame fit over outer edges of the first and second cover plates, and a plurality of mounting posts mounted to two opposite sides of the frame, the first cover plates being conventional ordinary cover plates, the second cover plates being ordinary cover plates;

wherein the first slit is located between the two second cover plates;

wherein the second slit is of a size of 0.5-2 mm;

wherein the second slit is of a size of 1 mm;

wherein the cutter body comprises a robot corresponding to the glass-substrate-to-be-cut and an elevation mechanism corresponding to the cover plate, the robot functioning to carry out operations of picking up and positioning the glass substrate, the elevation mechanism comprising a groove formed in the platform and a driving motor arranged to correspond to the cover plate assembly, the cover plate assembly being receivable in the groove, the groove having sidewalls forming recesses corresponding to the mounting posts of the cover plate assembly, the recess comprising a horizontal channel and down channels formed at two ends of the horizontal channel;

wherein when the robot moves the glass-substrate-to-be-cut to the platform or moves a cut glass substrate from the glass substrate, the robot extends to the platform, the mounting posts of the cover plate sliding up to the horizontal channel, whereby the robot, after completing the operation, is retrieved from the platform to allow the mounting posts of the cover plate to slide down into the down channels; and wherein the cutter body is a cutting wheel cutter body or a laser cutter body.

* * * * *